US008636340B2

(12) United States Patent
Dixon et al.

(10) Patent No.: US 8,636,340 B2
(45) Date of Patent: Jan. 28, 2014

(54) PRINTHEADS AND METHOD FOR ASSEMBLING PRINTHEADS

(75) Inventors: Michael J. Dixon, Richmond, KY (US); Jiandong Fang, Lexington, KY (US); Richard Earl Corley, Jr., Richmond, KY (US); Jeanne Marie Saldanha Singh, Lexington, KY (US); Frank E. Anderson, Sadieville, KY (US); Xiaoming Wu, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 235 days.

(21) Appl. No.: 13/046,845

(22) Filed: Mar. 14, 2011

(65) Prior Publication Data

US 2012/0236076 A1 Sep. 20, 2012

(51) Int. Cl.
*B41J 2/25* (2006.01)

(52) U.S. Cl.
USPC ..... 347/42; 347/49

(58) Field of Classification Search
USPC ..... 347/47, 42, 49, 13
See application file for complete search history.

(56) References Cited

U.S. PATENT DOCUMENTS 7,287,829 B2 * 10/2007 Silverbrook ..... 347/42

* cited by examiner

*Primary Examiner* — Lamson Nguyen
(74) *Attorney, Agent, or Firm* — Amster, Rothstein & Ebenstein LLP

(57) ABSTRACT

Disclosed is a printhead for a printer that includes a plurality of ejection chip units. Each ejection chip unit of the plurality of ejection chip units is configured to eject at least one fluid. The printhead further includes a plurality of supporting units. Each supporting unit of the plurality of supporting units is fluidly coupled with a corresponding ejection chip unit. The each supporting unit includes a plurality of trenches adapted to receive an adhesive to facilitate attachment of the each supporting unit with the corresponding ejection chip unit. Furthermore, the printhead includes a base unit fluidly coupled with the each supporting unit of the plurality of supporting units. The base unit is adapted to provide the at least one fluid to the each ejection chip unit through a corresponding to supporting unit. Further disclosed is a method for assembling the printhead.

6 Claims, 16 Drawing Sheets

PRINTHEADS AND METHOD FOR ASSEMBLING PRINTHEADS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to printers, and more particularly, to a printhead for a printer and a method for assembling the printhead.

2. Description of the Related Art

For obtaining large print swaths, a printer typically includes a page wide printhead that has an array of narrow heater chips (ejection chip units). The width of such narrow heater chips may generally be less than about two millimeters. Further, each heater chip of the page wide printhead includes about four to five fluid (ink) channels for fluids (inks), such as Cyan-Magenta-Yellow-blacK (CMYK) or Cyan-Magenta-Yellow-blacK-blacK (CMYKK). The aforementioned fluid channels may typically have about 100 micron thick walls, and are configured in the form of closely packed fluid channels.

However, the closely packed fluid channels within the each heater chip are required to be fed by horizontal micro fluidic channels from widely separated fluid channels configured in a printhead base (such as a ceramic base). The widely separated fluid channels of the printhead base are further connected to fluid bottles (ink reservoirs) that provide fluid to the fluid channels of the printhead base. FIG. 1 depicts a partial exploded schematic view of a typical page wide printhead 100. As shown in FIG. 1, the page wide printhead 100 includes a plurality of heater chips 110. The heater chips 110 may be stitched together, as shown in FIG. 1. Further, the heater chips 110 along with a Printed Circuit Board (PCB) 120 are mounted on a thin Liquid Crystal Polymer (LCP) layer 130 by utilizing a layer 140 of an adhesive tape (such as a Polyimide tape). The PCB 120 may also be coupled to a flexible cable 160 that includes conductive traces. The thin LCP layer 130 is further attached to a thick LCP layer 150 and/or a printhead base (i.e., ceramic base).

The thin LCP layer 130 includes a plurality of horizontal micro fluidic channels (not numbered) that may be fabricated by utilizing a process called injection molding. Further, the layer 140 of the adhesive tape may be provided with laser drilled holes and is used for covering the thin LCP layer 130. Furthermore, the heater chips 110 are mounted directly on the layer 140 of the adhesive tape. However, such configuration of the thin LCP layer 130 and the heater chips 110 with the layer 140 of the adhesive tape in between is associated with various issues, such as a low thermal conductivity of the layer 140 of the adhesive tape to dissipate heat from the heater chips 110 with higher power. Further, the heater chips 110 are mounted on the layer 140 of the adhesive tape, which is a soft layer, and such an arrangement leads to an unavoidable heater chip bow (i.e., deformity in the structure of the heater chips 110). Furthermore, lower hydrophilicity of polymer conduct holes for the thin LCP layer 130 as opposed to that of silicon holes causes easier air bubble trapping or fluid (ink) clogging within the printhead 100. Furthermore, large alignment tolerance between the holes in the layer 140 of the adhesive tape and the horizontal micro fluidic channels in the thin LCP layer 130 during a lamination process remains another major issue.

Accordingly, there persists a need for an efficient printhead and a method for assembling the printhead to address the aforementioned issues related with heat dissipation from heater chips of the printhead, deformation of the heater chips, air bubble trapping/fluid (ink) clogging within the printhead, and alignment tolerances within the printhead.

SUMMARY OF THE DISCLOSURE

In view of the foregoing disadvantages inherent in the prior art, the general purpose of the present disclosure is to provide a printhead for a printer and a method for assembling the printhead, by including all the advantages of the prior art, and overcoming the drawbacks inherent therein.

The present disclosure provides a printhead for a printer. The printhead includes a plurality of ejection chip units. Each ejection chip unit of the plurality of ejection chip units is configured to eject at least one fluid. The printhead further includes a plurality of supporting units. Each supporting unit of the plurality of supporting units is fluidly coupled with a corresponding ejection chip unit of the plurality of ejection chip units. The each supporting unit includes a plurality of trenches adapted to receive an adhesive to facilitate attachment of the each supporting unit with the corresponding ejection chip unit of the plurality of ejection chip units. Furthermore, the printhead includes a base unit fluidly coupled with the each supporting unit of the plurality of supporting units and configured to carry the plurality of supporting units thereupon. The base unit is adapted to provide the at least one fluid to the each ejection chip unit through a corresponding supporting unit fluidly coupled to the each ejection chip unit.

Additionally, the present disclosure provides a method for assembling a printhead of a printer. The method includes fabricating a plurality of supporting units to configure a plurality of trenches on each supporting unit of the plurality of supporting units. The method further includes filling each trench of the plurality of trenches of the each supporting unit with an adhesive for attaching an ejection chip unit to the each supporting unit, in order to prevent excess adhesive from being squeezed out to block fluid ports and/or channels of the at least one of the ejection chip unit and the each supporting unit.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides a printhead for a printer. The printhead includes a plurality of ejection chip units. Each ejection chip unit of the plurality of ejection chip units is configured to eject at least one fluid. The printhead includes a plurality of supporting units. Each supporting unit of the plurality of supporting units is fluidly coupled with a corresponding ejection chip unit of the plurality of ejection chip units. The each supporting unit includes a plurality of trenches. The plurality of trenches is adapted to receive an adhesive to facilitate attachment of the each supporting unit with the corresponding ejection chip unit of the plurality of ejection chip units. Further, the printhead includes a base unit fluidly coupled with the each supporting unit of the plurality of supporting units and configured to carry the plurality of supporting units thereupon. The base unit is adapted to provide the at least one fluid to the each ejection chip unit through a corresponding supporting unit fluidly coupled to the each ejection chip unit. The printhead of the present disclosure is described in conjunction with FIGS. 2-7.

Figure 1:
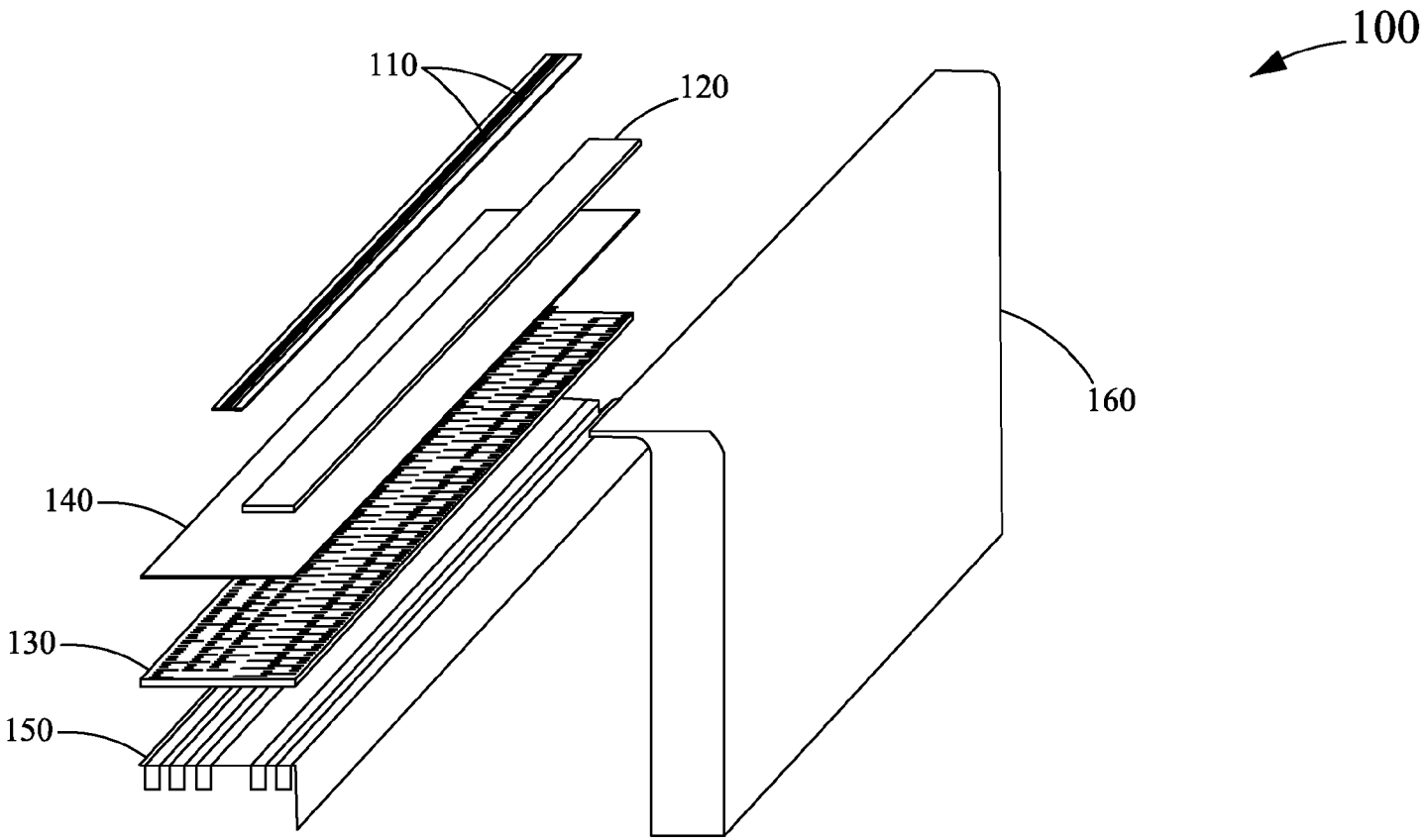
FIG. 1 illustrates a partial exploded schematic view of a prior art page wide printhead.
Figure 2:
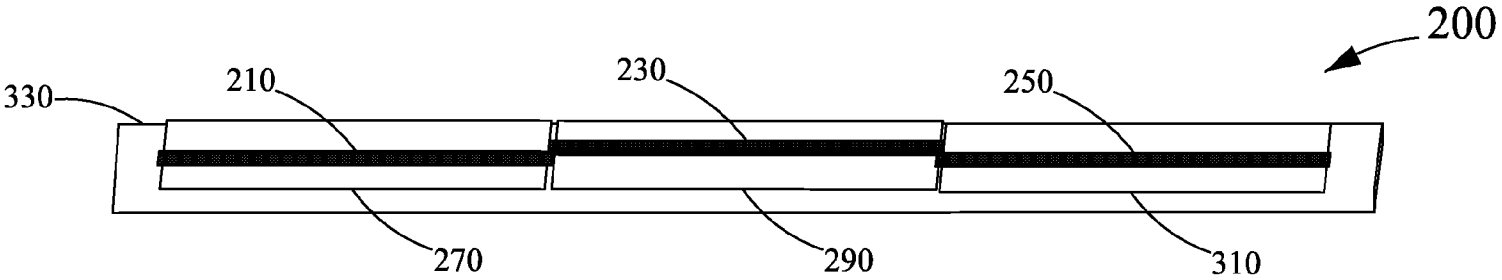
FIG. 2 illustrates a schematic view of a printhead for a printer, in accordance with an embodiment of the present disclosure.
Figure 3:
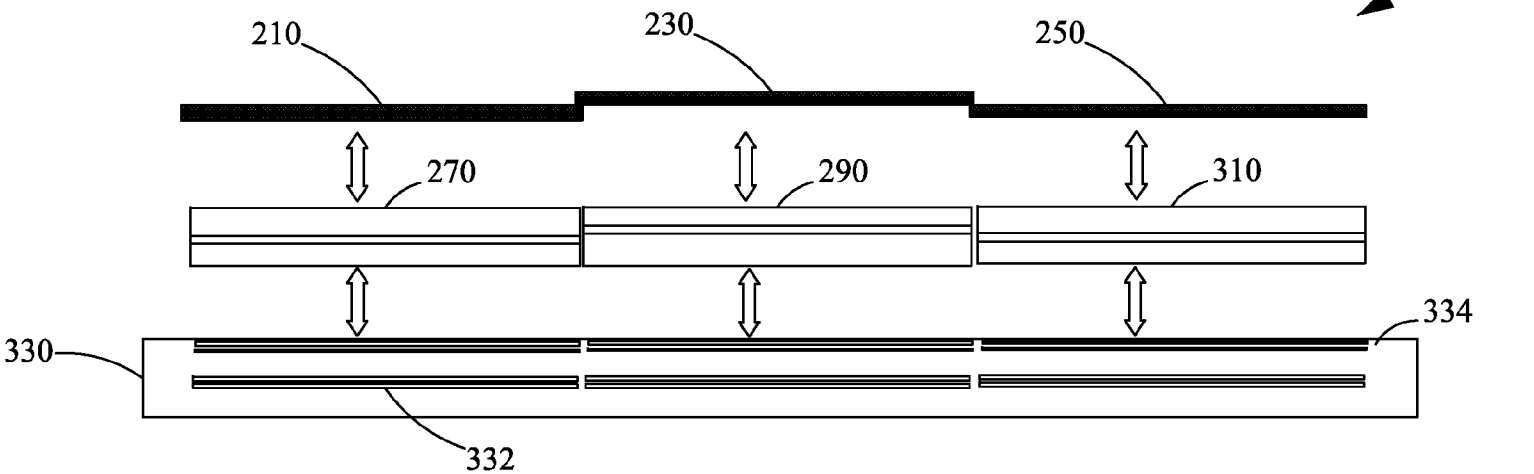
FIG. 3 illustrates an exploded schematic view of the printhead of FIG. 2.

FIG. 2 illustrates a schematic view of a printhead 200 for a printer, and FIG. 3 illustrates an exploded schematic view of the printhead 200. The printhead 200 includes a plurality of ejection chip units, such as an ejection chip unit 210, an ejection chip unit 230, and an ejection chip unit 250. Each ejection chip unit of the ejection chip units 210, 230 and 250 is configured to eject at least one fluid therefrom. For the purpose of this description, the each ejection chip unit of the ejection chip units 210, 230 and 250 is configured to eject four types of fluids that are inks of a cyan color, a magenta color, a yellow color and a black color.

FIGS. 2 and 3 depict only 3 ejection chip units, i.e., the ejection chip units 210, 230 and 250. However, it should be understood that the printhead 200 may have any number of ejection chip units as per a manufacturer's preference. Further, the ejection chip units 210, 230 and 250 are arranged in 2 rows (not numbered) with 2-10 overlapping nozzles (not shown) of consecutive ejection chip units, such as the ejection chips 210 and 230. However, it should be understood that the ejection chip units 210, 230 and 250 may be arranged in any possible manner as per a manufacturer's preference.

Figure 4:
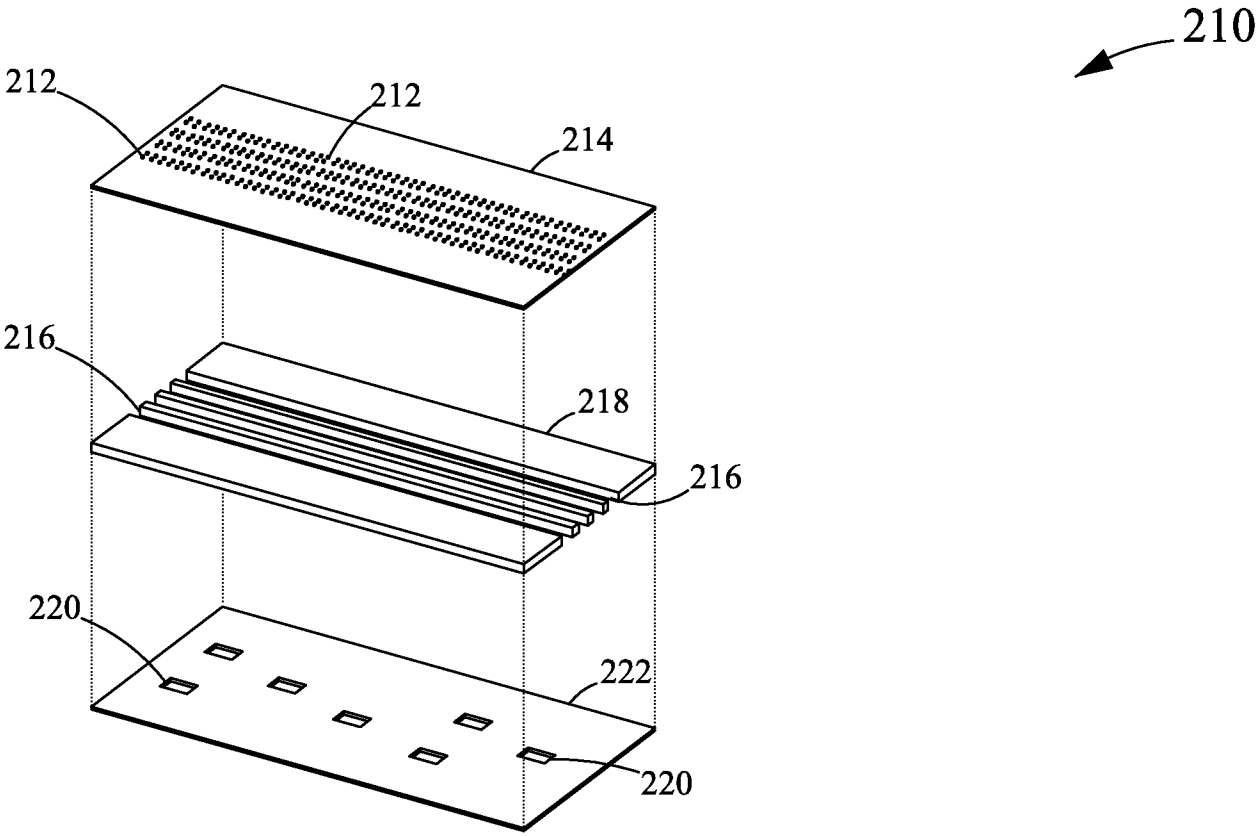
FIG. 4 illustrates an exploded schematic view of an ejection chip unit of the printhead of FIG. 2.

Referring to FIG. 4, the each ejection chip unit, such as the ejection chip unit 210, of the plurality of ejection chip units includes a first plurality of ports, such as a first plurality of ports 212 to feed firing chambers (not shown) for fluid ejection. The first plurality of ports 212 is hereinafter referred to as 'ports 212'. Each port of the ports 212 are connected to a corresponding firing chamber (not shown) of the printhead 200. The ports 212 are configured on a first ultra thin layer 214 of the ejection chip unit 210. The each ejection chip unit, such as the ejection chip unit 210, further includes a plurality of fluid (ink) channels, such as a plurality of fluid channels 216. For the purpose of this description, the ejection chip unit 210 includes four fluid channels 216 that are adapted to carry the fluids (inks) of the cyan color, the magenta color, the yellow color and the black color, respectively.

The fluid channels 216 are configured beneath the ports 212 on a substrate layer 218. Each fluid channel of the fluid channels 216 is fluidly coupled with at least one corresponding port of the ports 212. The term, "at least one corresponding port" as used herein refers to one or more ports of the ports 212 that are aligned with a respective fluid channel of the fluid channels 216 and may carry a fluid (ink) of the same type (color) as carried by the respective fluid channel.

Further, the each ejection chip unit, such as the ejection chip unit 210, may include a second plurality of ports, such as a second plurality of ports 220 (i.e., 'Manifold holes') configured beneath the fluid channels 216 and on a second ultra thin layer 222. The second plurality of ports 220 is hereinafter referred to as ports 220. At least one port of the ports 220 may be fluidly coupled with a corresponding fluid channel of the fluid channels 216. The term, "a corresponding fluid channel" as used herein refers to an fluid channel of the fluid channels 216 that may be aligned with respective at least one port of the ports 220 and may carry a fluid of the same type (color) as carried by the respective at least one port. Further, the ports 220 may be separated from each other at a distance of about 0.5-1.5 millimeter. As depicted in FIG. 4, the fluid channels 216 are sandwiched between the first ultra thin layer 214 and the second ultra thin layer 222.

For simplicity, FIG. 4 only depicts the ejection chip unit 210, however, it should be understood that the ejection chip units 230 and 250 also include a first plurality of ports; a plurality of fluid channels configured beneath the first plurality of ports; and a second plurality of ports that are configurationally and functionally similar to the ports 212, the fluid channels 216, and the ports 220 of the ejection chip unit 210.

Referring again to FIGS. 2 and 3, the printhead 200 further includes a plurality of supporting units, such as a supporting unit 270, a supporting unit 290 and a supporting unit 310. Each supporting unit of the plurality of supporting units is configured in the form of a silicon tile. Further, the each supporting unit of the supporting units 270, 290 and 310, is fluidly coupled with a corresponding ejection chip unit of the ejection chip units 210, 230 and 250. For example, the second ultra thin layer 222 having the ports 220 of the ejection chip unit 210 is in direct fluidic contact with the supporting unit 270. The each ejection chip unit of the ejection chip units 210, 230 and 250 is further supported by a single supporting unit. Specifically, the ejection chip unit 210 is supported on the supporting unit 270, the ejection chip unit 230 is supported on the supporting unit 290, and the ejection chip unit 250 is supported on the supporting unit 310.

Figure 5:
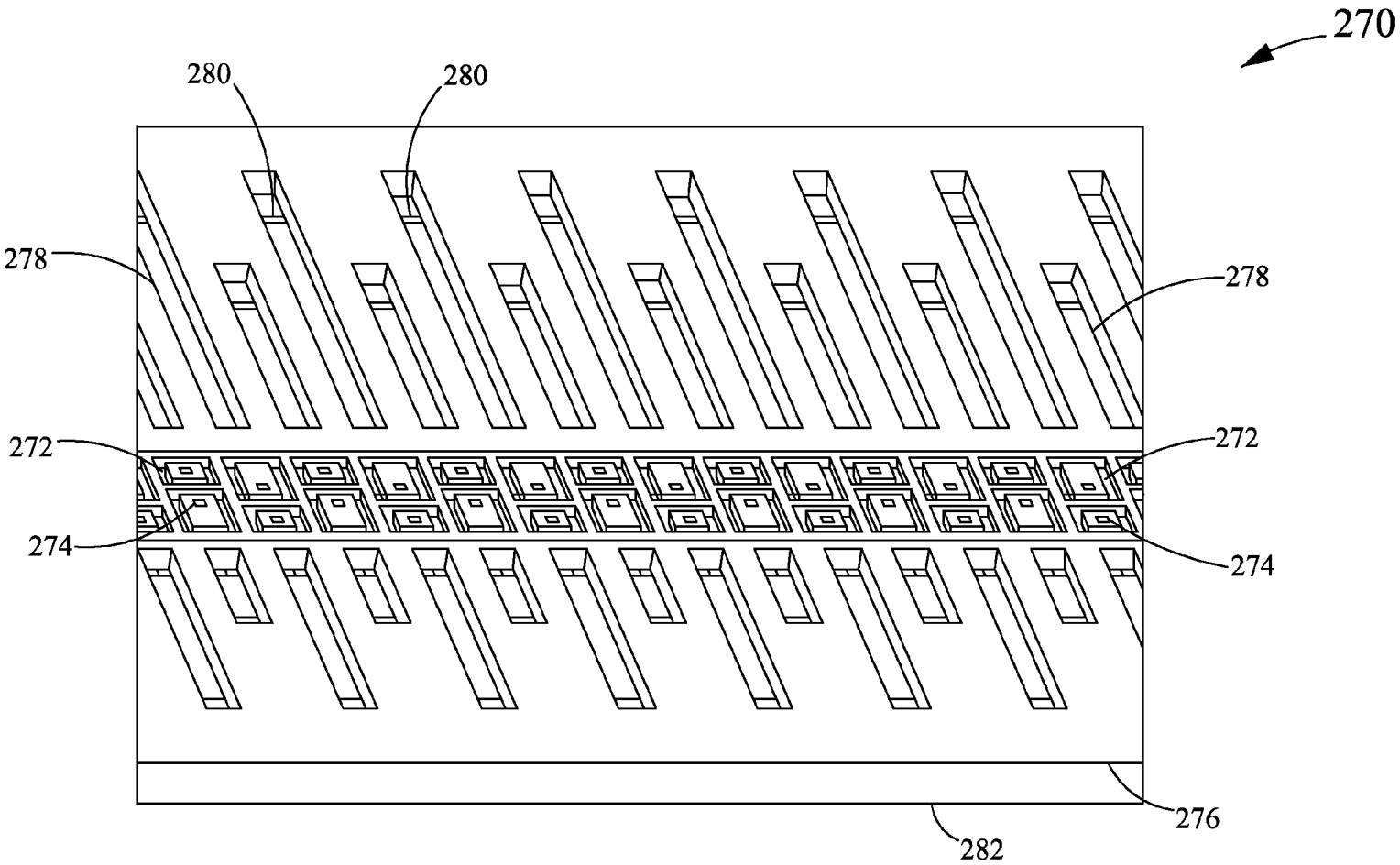
FIG. 5 illustrates a positive top perspective view of a supporting unit of the printhead of FIG. 2.

The each supporting unit, such as the supporting unit 270, includes a plurality of trenches, such as a plurality of trenches 272 (as depicted in FIG. 5). The trenches 272 are adapted to receive an adhesive to facilitate attachment of the supporting unit 270 with the corresponding ejection chip unit 210. The trenches 272 may be configured to have any shape such as a shape of a square, a shape of a rectangle, a shape of circle, and the like. Further, the trenches 272 may be formed as two or more concentric shapes, such as two concentric squares.

Further, the each supporting unit, such as the supporting unit 270, includes a first plurality of ports, such as a first plurality of ports 274 (as shown in FIG. 5). The first plurality of ports 274 is hereinafter referred to as 'ports 274'. The ports 274 are configured at a top portion 276 of the supporting unit 270, as shown in FIG. 5. Each port of the ports 274 is fluidly coupled with a corresponding port of the ports 220 of the ejection chip unit 210 to form a port-to-port connection between the ejection chip unit 210 and the supporting unit 270. The term, "a corresponding port" as used herein refers to a port of the ports 220 that is aligned with a respective port of the ports 274 and may carry a fluid of the same type (color) as carried by the respective port. For the purpose of this description, the ports 220 on the ejection chip unit 210 facilitate a port-to-port fluid coupling with the ports 274 of the supporting unit 270. However, in the absence of the ports 220 on the ejection chip unit 210, the ejection chip unit 210 may be fluidly coupled to the supporting unit 270 via channel-to-port through the channels 216 of the ejection chip unit 210 and the ports 274 on the supporting unit 270 directly.

Figure 6:
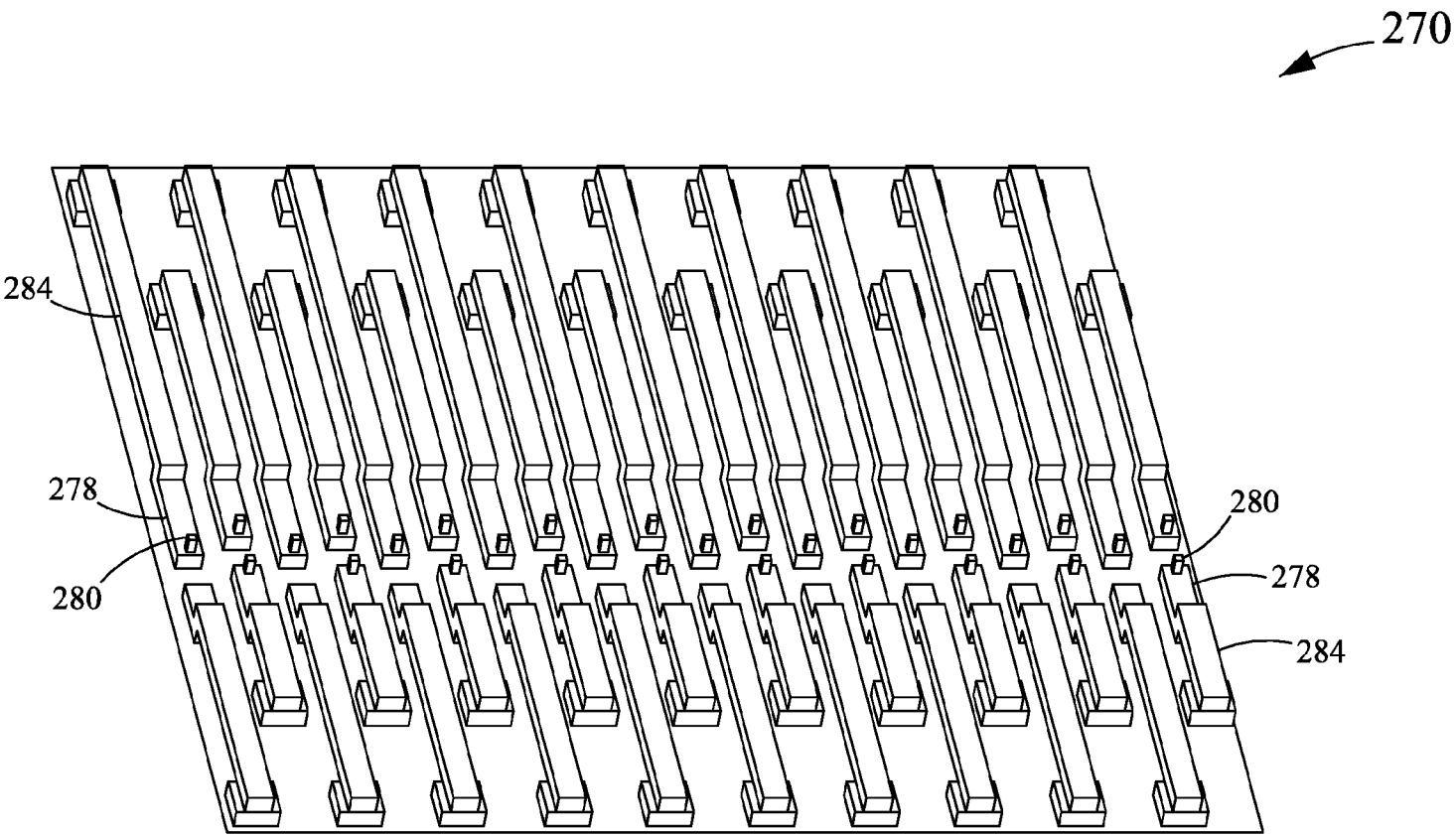
FIG. 6 illustrates a negative top view of the supporting unit of FIG. 5.

The each supporting unit, such as the supporting unit 270, further includes a first plurality of channels, such as a first plurality of channels 278 (as depicted in FIG. 5). The first plurality of channels 278 is hereinafter referred to as 'channels 278'. The channels 278 are configured at the top portion 276 of the supporting unit 270. Furthermore, the each supporting unit, such as the supporting unit 270, includes a second plurality of ports, such as a second plurality of ports 280 (as shown in FIGS. 5 and 6). The second plurality of ports 280 is hereinafter referred to as 'ports 280'. The ports 280 are configured at a bottom portion 282 of the supporting unit 270. Each port of the ports 280 is fluidly coupled with a corresponding channel of the channels 278. The term, "a corresponding channel" as used herein refers to a channel of the channels 278 that is aligned with a respective port of the ports 280 and may carry a fluid of the same type (color) as carried by the respective port.

Further, the each supporting unit, such as the supporting unit 270, includes a second plurality of channels, such as a second plurality of channels 284 (as shown in FIG. 6). The second plurality of channels 284 is hereinafter referred to as 'channels 284'. The channels 284 are configured at the bottom portion 282 of the supporting unit 270. Each channel of the channels 284 is fluidly coupled with a corresponding port of the ports 274 and a corresponding channel of the channels 278. Specifically, the each channel of the channels 284 overlaps with the corresponding channel of the channels 278 for the fluidic coupling therebetween. The term, "a corresponding port" as used herein refers to a port of the ports 274 that is aligned with a respective channel of the channels 284 and may carry a fluid of the same type as carried by the respective channel, and "a corresponding channel" as used herein refers to a channel of the channels 278 that is aligned with the respective channel of the channels 284 and may carry the fluid of the same type as carried by the respective channel.

Accordingly, a fluid may enter the ports 280 configured at the bottom portion 282 of the supporting unit 270. Thereafter, the fluid may flow to the channels 278 configured at the top portion 276 of the supporting unit 270. The fluid may then flow from the channels 278 to the channels 284. Subsequently, the fluid may flow from the channels 284 to the ports 274 of the supporting unit 270. It is to be understood that the shape and orientation of the channels 278 and 284; and the ports 274 and 280, as depicted in FIGS. 5 and 6 should not be considered as a limitation to the present disclosure.

For the sake of brevity, only the supporting unit 270 and the components thereof are explained above and depicted in FIGS. 5 and 6. However, it should be understood that each supporting unit of the supporting units 290 and 310 also include a first plurality of ports configured at a respective top portion, a first plurality of channels configured at the respective top portion, a second plurality of ports configured at a respective bottom portion, and a second plurality of channels configured at the respective bottom portion that are configurationally and functionally similar to the ports 274, the channels 278, the ports 280 and the channels 284, respectively, of the supporting unit 270. Further, FIGS. 2 and 3 depict only 3 supporting units, i.e., the supporting units 270, 290 and 310, corresponding to the ejection chip units 210, 230 and 250. However, it should be understood that the printhead 200 may have any number of supporting units as per a manufacturer's preference.

Referring again to FIGS. 2 and 3, the printhead 200 further includes a base unit 330. The base unit 330 is fluidly coupled with the each supporting unit, such as the supporting units 270, 290 and 310, of the plurality of supporting units. The base unit 330 is configured to carry the plurality of supporting units. As depicted in FIG. 2, the base unit 330 is adapted to carry the supporting units 270, 290 and 310 thereupon. Further, the base unit 330 is adapted to provide the at least one fluid to the each ejection chip unit of the plurality of ejection chip units through a corresponding supporting unit fluidly coupled to the each ejection chip unit. Specifically, the base unit 330 is adapted to provide the at least one fluid to the ejection chip units 210, 230 and 250 through corresponding supporting units 270, 290 and 310 that are fluidly coupled to the ejection chip units 210, 230 and 250, respectively.

Figure 7:
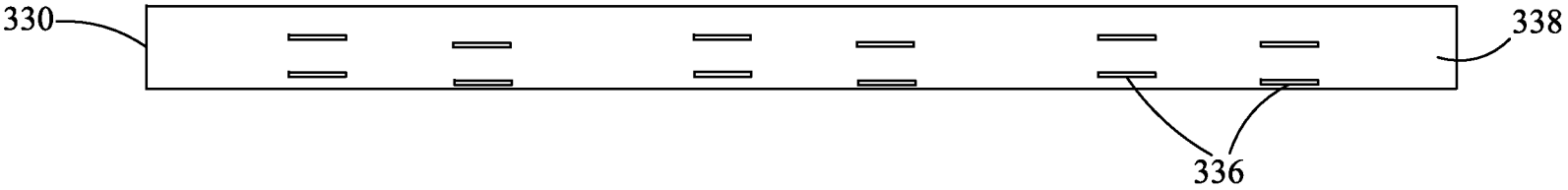
FIG. 7 illustrates a bottom view of a base unit of the printhead of FIG. 2.

As depicted in FIG. 3, the base unit 330 includes a plurality of channels (slots) 332 on a top portion 334 of the base unit 330. Each channel of the channels 332 is fluidly coupled with at least one corresponding port of the second plurality of ports, such as the ports 280, of the each supporting unit, such as the supporting unit 270 to form a port-to-channel connection between the each supporting unit and the base unit 330. The term "at least one corresponding port" as used herein refers to one or more ports of the second plurality of ports that are aligned with a respective channel of the channels 332 and may carry a fluid of the same type as carried by the respective channel. As depicted in FIG. 7, the base unit 330 also includes a plurality of ports 336 configured beneath the channels 332 and at a bottom portion 338 of the base unit 330. At least one port of the ports 336 is fluidly coupled to a corresponding channel of the channels 332. The term "a corresponding channel" as used herein refers to a channel of the channels 332 that is aligned with one or more respective ports of the ports 336 and may carry a fluid of the same type as carried by the respective one or more ports. The at least one port of the ports 336 is further fluidly coupled with a corresponding fluid reservoir/bottle (not shown) for receiving a fluid from the fluid reservoir. Specifically, the at least one port of the ports 336 is connected with the corresponding fluid reservoir through a means such as a gasket. Accordingly, the ports 336 facilitate in movement of the fluid from the fluid reservoir towards the plurality of supporting units.

The base unit 330 may be a ceramic base and may be made by a conventional dry press molding process. Alternatively, the base unit 330 may be made of other inert rigid materials, such as Liquid Crystal Polymer (LCP), High Temperature Cofired Ceramic (HTCC), Low Temperature Cofired Ceramic (LTCC), and carbon fiber reinforced glass or plastic plates.

Furthermore, the printhead 200 may include an electrically functional unit (not shown) coupled with the each ejection chip unit, such as the ejection chip unit 210. The electrically functional unit may be a Printed Circuit Board (PCB) mounted on the corresponding supporting unit, such as the supporting unit 270. The electrically functional unit may provide electrical connections required for optimum functioning of the printhead 200 with the printer.

In use, the ports 336 of the base unit 330 may receive one or more fluids from one or more corresponding fluid reservoirs. The one or more fluids may then flow from the ports 336 to corresponding channels 332 of the base unit 330. Thereafter, the one or more fluids may flow from the channels 332 to the at least one corresponding port of respective second plurality of ports, such as the ports 280, of the each supporting unit, such as the supporting unit 270. The one or more fluids may then flow to respective first plurality of channels, such as the channels 278, of the each supporting unit. Subsequently, the one or more fluids may flow from the respective first plurality of channels to respective second plurality of channels, such as the channels 284, of the each supporting unit. Thereafter, the one or more fluids may flow from the respective second plurality of channels to respective first plurality of ports, such as the ports 274, of the each supporting unit. Subsequently, the one or more fluids may then flow from the each supporting unit, such as the supporting unit 270, to the corresponding ejection chip unit, such as the ejection chip unit 210, through the respective first plurality of ports of the each supporting unit. Specifically, the one or more fluids may flow from the respective first plurality of ports of the each supporting unit, such as the supporting unit 270, to respective second plurality of ports, such as the ports 220, of the each ejection chip unit, such as the ejection chip unit 210. Thereafter, the one or more fluids may flow to corresponding fluid channels, such as the fluid channels 216, of the each ejection chip unit, such as the ejection chip unit 210, and may then flow to respective first plurality of ports, such as the ports 212, of the each ejection chip unit. Subsequently, the one or more fluids may be ejected/fired from the each ejection chip unit.

In another aspect, a method for assembling the printhead of the present disclosure, such as the printhead 200 of FIGS. 2 and 3, is provided. The method is explained in conjunction with FIGS. 8-29, in accordance with various embodiments of the present disclosure.

Figure 8:
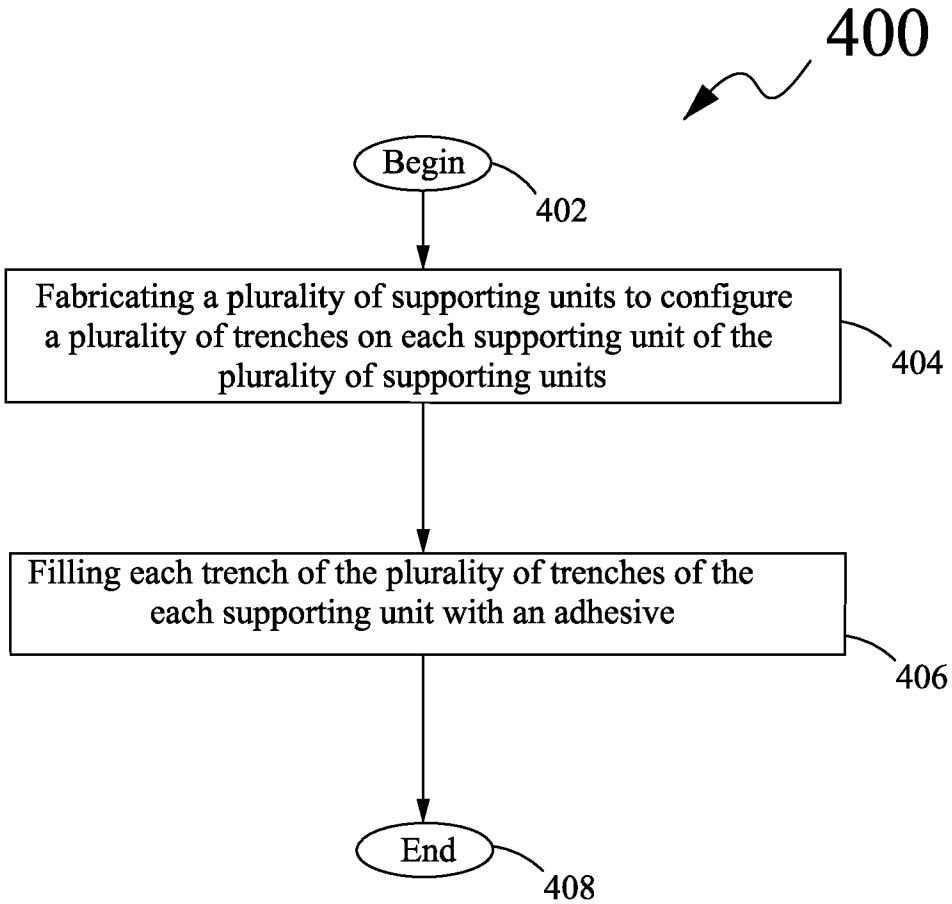
FIG. 8 is a flow chart depicting a method for assembling the printhead of FIG. 2.

FIG. 8 depicts a method 400 for assembling the printhead 200, in accordance with an embodiment of the present disclosure. Further, reference is made to the printhead 200 and the components thereof, and the FIGS. 2-7 for describing the method 400 of the present disclosure. The method 400 begins at step 402. At 404, the plurality of supporting units, such as the supporting units 270, 290 and 310, are fabricated to configure a plurality of trenches, such as the trenches 272, on the each supporting unit of the plurality of supporting units. At step 406, each trench of the plurality of trenches of the each supporting unit is filled with an adhesive by use of an automatic or manual adhesive dispenser. Subsequently, an ejection chip unit, such as the ejection chip units 210, 230 and 250, of the plurality of ejection chip units is attached onto the each supporting unit. More specifically, the ejection chip units 210, 230 and 250 are attached to respective supporting units 270, 290 and 310. The method 400 may also include attaching the base unit 330 with the plurality of supporting units. The method ends at step 408.

Figure 9:
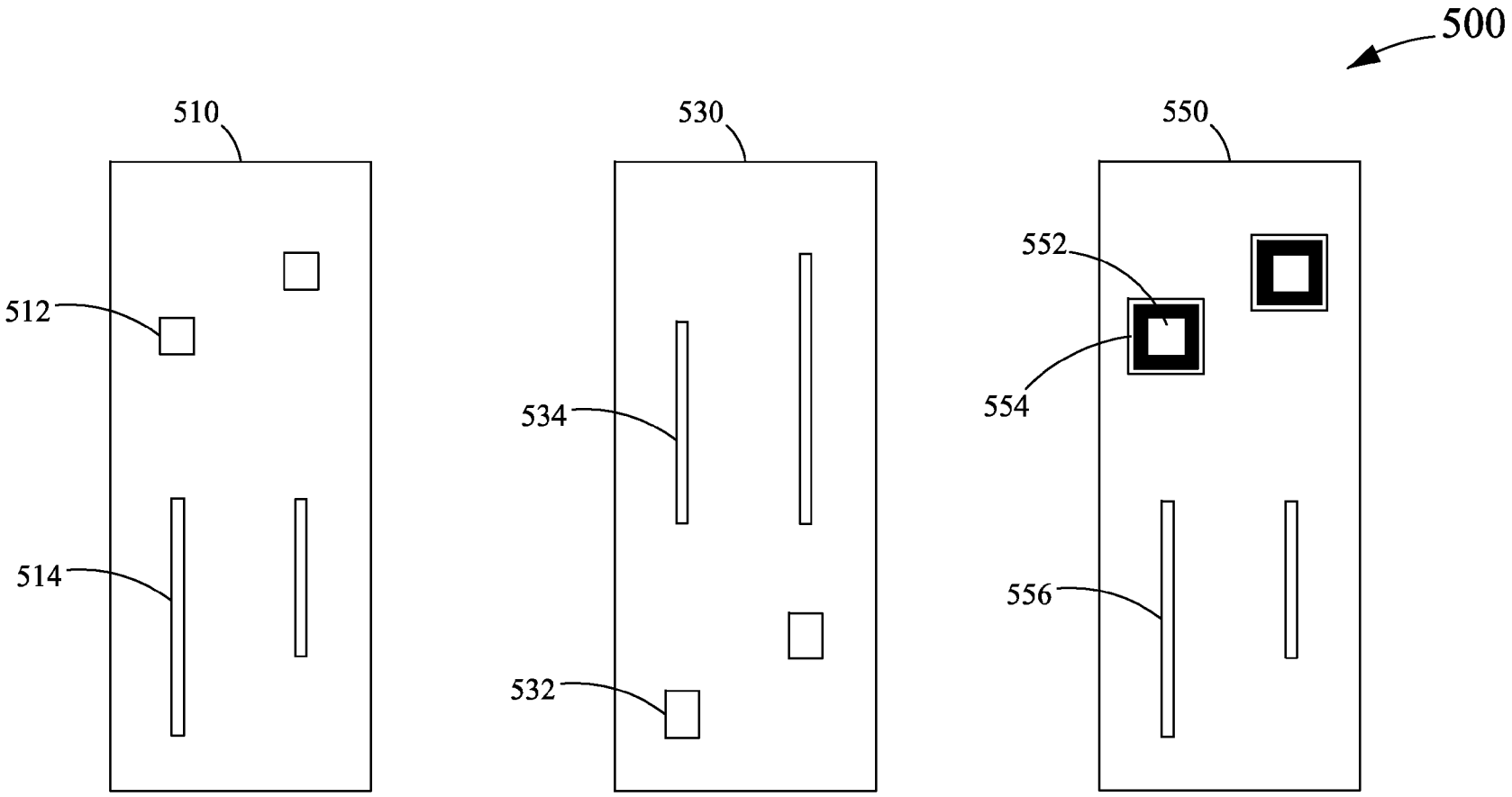
FIG. 9 illustrates a first set of masks utilized to fabricate the supporting unit of the printhead of FIG. 2.

The plurality of supporting units may be fabricated from a silicon wafer, such as silicon <100>0 wafer (200-800 micron thick), using different types of fabrication methods. FIGS. 10-17 illustrate a first process flow, i.e., Deep reactive-ion etching (DRIE) only process, for fabrication of the each supporting unit, such as the supporting unit 270, by using a first set of masks 500 depicted in FIG. 9. Specifically, FIG. 9 depicts a first mask 510, a second mask 530 and a third mask 550 (a photo-resist mask) in the first set of masks 500. Further, FIGS. 10-17 illustrate cross-sectional views for a silicon wafer 600 depicting the formation of a single port of the ports 274, a single channel of the channels 278, a single port of the ports 280, a single channel of the channels 284, and a single trench of the trenches 272 of the supporting unit 270, only for the purposes of simplicity. Accordingly, it should be understood that other ports of the ports 274, other channels of the channels 278, other ports of the ports 280, other channels of the channels 284, and other trenches of the trenches 272 are also formed simultaneously using the same first process flow. Further, the silicon wafer 600 may be used to fabricate other supporting units, such as the supporting units 290 and 310.

Figure 11:
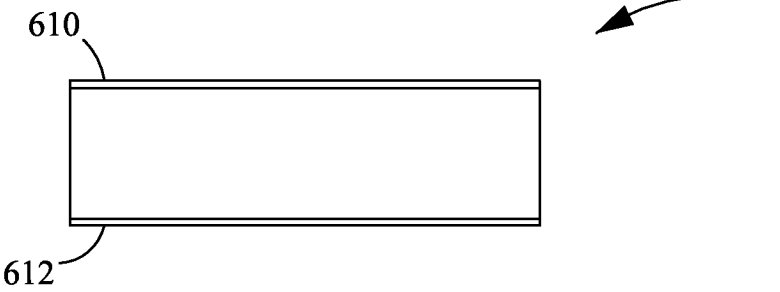
FIG. 10-17 illustrate cross-sectional views for a silicon wafer being used for fabricating the supporting unit with the help of the first set of masks of FIG. 9, in accordance with an embodiment of the present disclosure.
Figure 12:
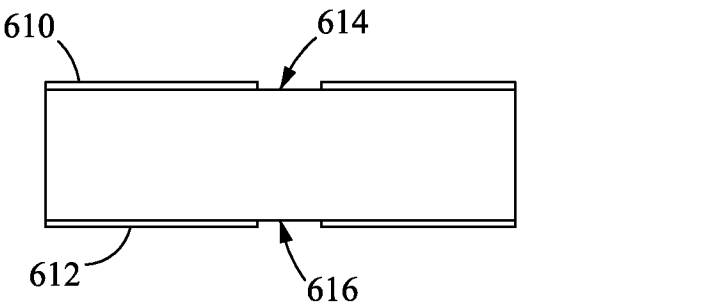
Figure 10:
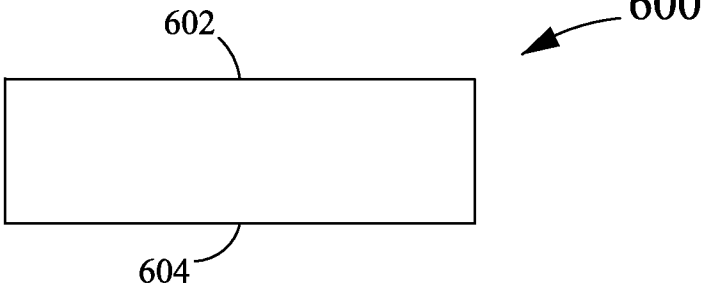

According to the first process flow, the silicon wafer 600 of FIG. 10 is coated on both a top surface 602 and a bottom surface 604 with either thermally grown or chemical vapor deposited silicon oxide, depicted as a top layer 610 and a bottom layer 612, respectively in FIG. 11. Thereafter, the top surface 602 is fabricated in a first predetermined pattern, as depicted in FIG. 12, with the help of the first mask 510 to define the ports 274 and the channels 278 at the top portion 276 of the supporting unit 270. Specifically, the top surface 602 is fabricated in the first predetermined pattern by hydrofluoric acid based Buffered Oxide Etchant (BOE) etching. The first predetermined pattern corresponds to the first mask 510 that includes a plurality of openings, such as an opening 512, corresponding to a port of the ports 274; and a plurality of slots, such as a slot 514, corresponding to a top portion of a channel of the channels 278 of the supporting unit 270 (as depicted in FIG. 9). It should be understood that the first mask 510 has been shown to include only two openings and two slots for two types of fluids (i.e., fluids of specific types) for simplicity, however, the first mask 510 may have any number of such openings and slots depending on the number of the ports 274 and the channels 278 that need to be created within the supporting unit 270. As depicted in FIG. 12, the top surface 602 is patterned to remove portions of silicon oxide to form a plurality of recesses, such as a recess 614, in the top layer 610 to define the ports 274 and the channels 278, when the first mask 510 is placed over the top layer 610 provided on the top surface 602 of the silicon wafer 600.

Subsequently, the bottom surface 604 of the silicon wafer 600 is fabricated in a second predetermined pattern, as depicted in FIG. 12, using the second mask 530 to define the ports 280 and the channels 284 at the bottom portion 282 of the supporting unit 270. Specifically, the bottom surface 604 is fabricated in the second predetermined pattern by BOE etching. The second predetermined pattern corresponds to the second mask 530 that includes a plurality of openings, such as an opening 532, corresponding to a port of the ports 280; and a plurality of slots, such as a slot 534, corresponding to a bottom portion of a channel of the channels 284 of the supporting unit 270 (as depicted in FIG. 9). It should be understood that the second mask 530 has been shown to include only two openings and two slots for two types of fluids (i.e., fluids of specific types), however, the second mask 530 may include any number of such openings and slots depending on the number of the ports 280 and the channels 284 of the supporting unit 270. Accordingly, the bottom surface 604 is patterned to remove portions of silicon oxide to form a plurality of recesses, such as a recess 616, in the bottom layer 612 to define the ports 280 and the channels 284, when the second mask 530 is placed over bottom layer 612 provided on the bottom surface 604 of the silicon wafer 600.

Figure 13:
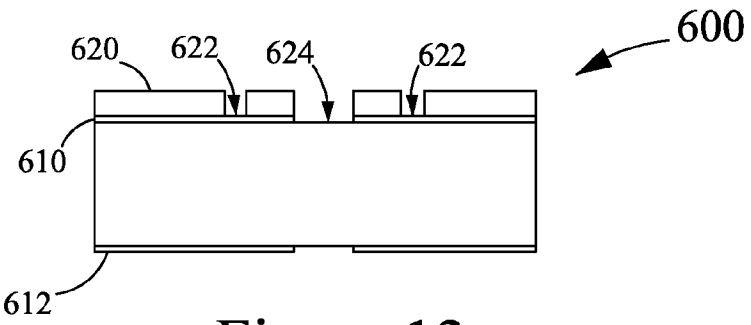

Thereafter, the top surface 602 of the silicon wafer 600 is fabricated in a third predetermined pattern, as depicted in FIG. 13, using the third mask 550 for coating the top surface 602 with a layer 620 of a photo-resist material. The layer 620 includes a plurality of recesses 622 to define the trenches 272 to be configured on the supporting unit 270. The layer 622 may also have additional recesses, such as a recess 624, to define the ports 274 and the channels 278. The third predetermined pattern corresponds to the third mask 550 that includes a plurality of openings, such as an opening 552 and an opening 554; and a plurality of slots, such as a slot 556 (as depicted in FIG. 9). The opening 552 corresponds to the port of the ports 274; the opening 554 corresponds to a trench of the trenches 272, and the slot 556 corresponds to the channel of the channels 278 of the supporting unit 270.

Figure 14:
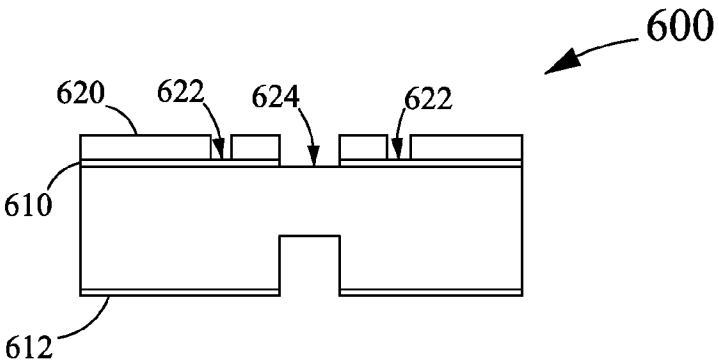

Subsequently, the bottom surface 604 is etched to form the ports 280 and the channels 284 at the bottom portion 282 of the supporting unit 270, as depicted in FIG. 14. Specifically, a DRIE process is used to recess the bottom surface 604 to a half of the thickness of the silicon wafer 600.

Figure 15:
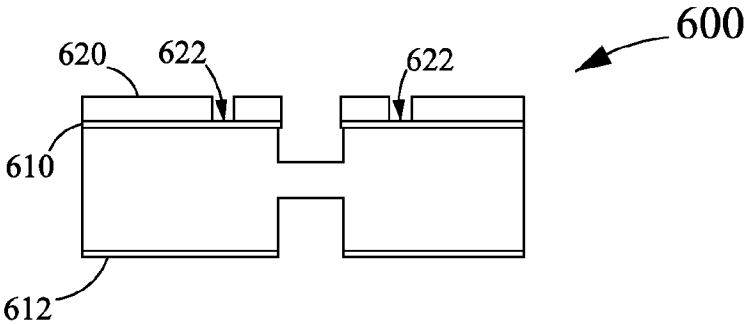

Thereafter, the top surface 602 is etched to form the ports 274 and the channels 278 at the top portion 276 of the supporting unit 270, as depicted in FIG. 15. Specifically, a DRIE process is used to recess the top surface 602 to about ¼ of the thickness of the silicon wafer 600.

Figure 16:
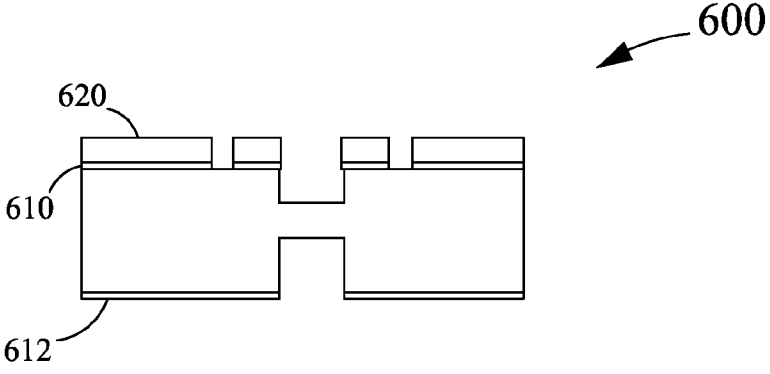

Respective areas corresponding to the recesses 622 are then etched for configuring the trenches 272 on the supporting unit 270, as depicted in FIG. 16. Specifically, BOE etching is used to remove exposed silicon oxide from the respective areas.

Figure 18:
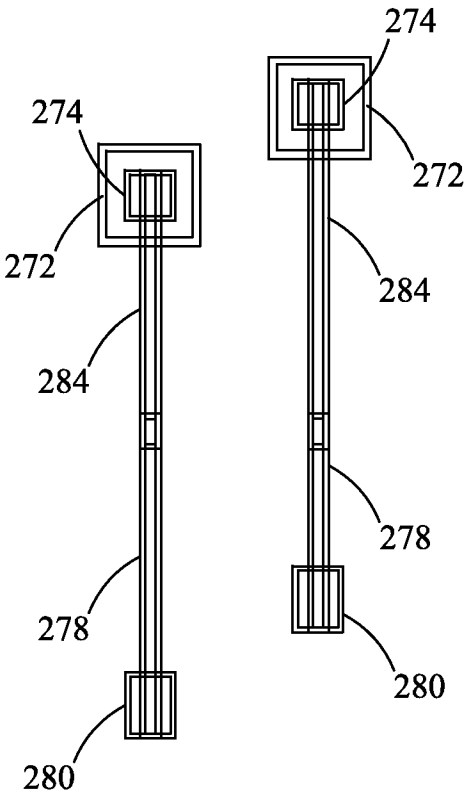
FIG. 18 illustrates an overlay for a first and a second plurality of channels, a first and a second plurality of ports, and a plurality of trenches of the supporting unit of the printhead of FIG. 2.
Figure 17:
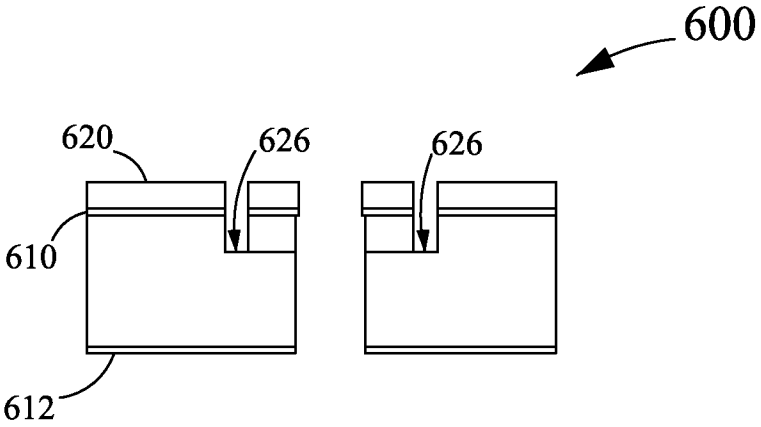

Subsequently, the silicon wafer 600 is etched further to form a plurality of slots 626 that correspond to the trenches 272, and to fluidly couple and vertically connect the each port of the ports 274 with a corresponding channel of the channels 284, the each channel of the channels 284 with the corresponding channel of the channels 278, and the each channel of the channels 278 with a corresponding port of the ports 280, as depicted in FIG. 17. Specifically, a DRIE process is used to further recesses silicon wafer 600 to about ¼ of the thickness. By way of the aforementioned fabrication process, respective bottom portions (not numbered) of each of the trenches 272 still remain about ¼ of the thickness above respective ceiling of the each channel of the channels 284. Positive top view of the fabricated supporting unit 270 is depicted in FIG. 5. The trenches 272 around the ports 274 may receive the adhesive in volume less than a volume of the each trench of the trenches 272, in order to avert squeezing of the adhesive when the ejection chip unit 210 is attached to the supporting unit 270, thereby preventing blocking of the ports 274. The adhesive may be dispensed via methods such as dot dispensing, screen printing, stencil printing and the like, on a plateau inside the trenches 272, where width of the plateau may be about 150 microns. FIG. 18 illustrates an overlay of the ports 274, the channels 278, the ports 280 and the channels 284; and the trenches 272 of the supporting unit 270 of the printhead 200, so obtained after fabrication.

The sequence of the above-specified steps, as depicted in FIGS. 10-17, for fabricating the supporting unit 270 should not be construed as a limitation to the scope of the present disclosure. Further, FIGS. 10-17 only depict the fabrication of the supporting unit 270, accordingly, it should be understood that other supporting units, such as the supporting units 290 and 310, may also be fabricated in the manner similar to that for the supporting unit 270 either from the silicon wafer 600 or a different silicon wafer depending on a manufacturer's preferences and/or dimensions of the silicon wafer 600.

Figure 19:
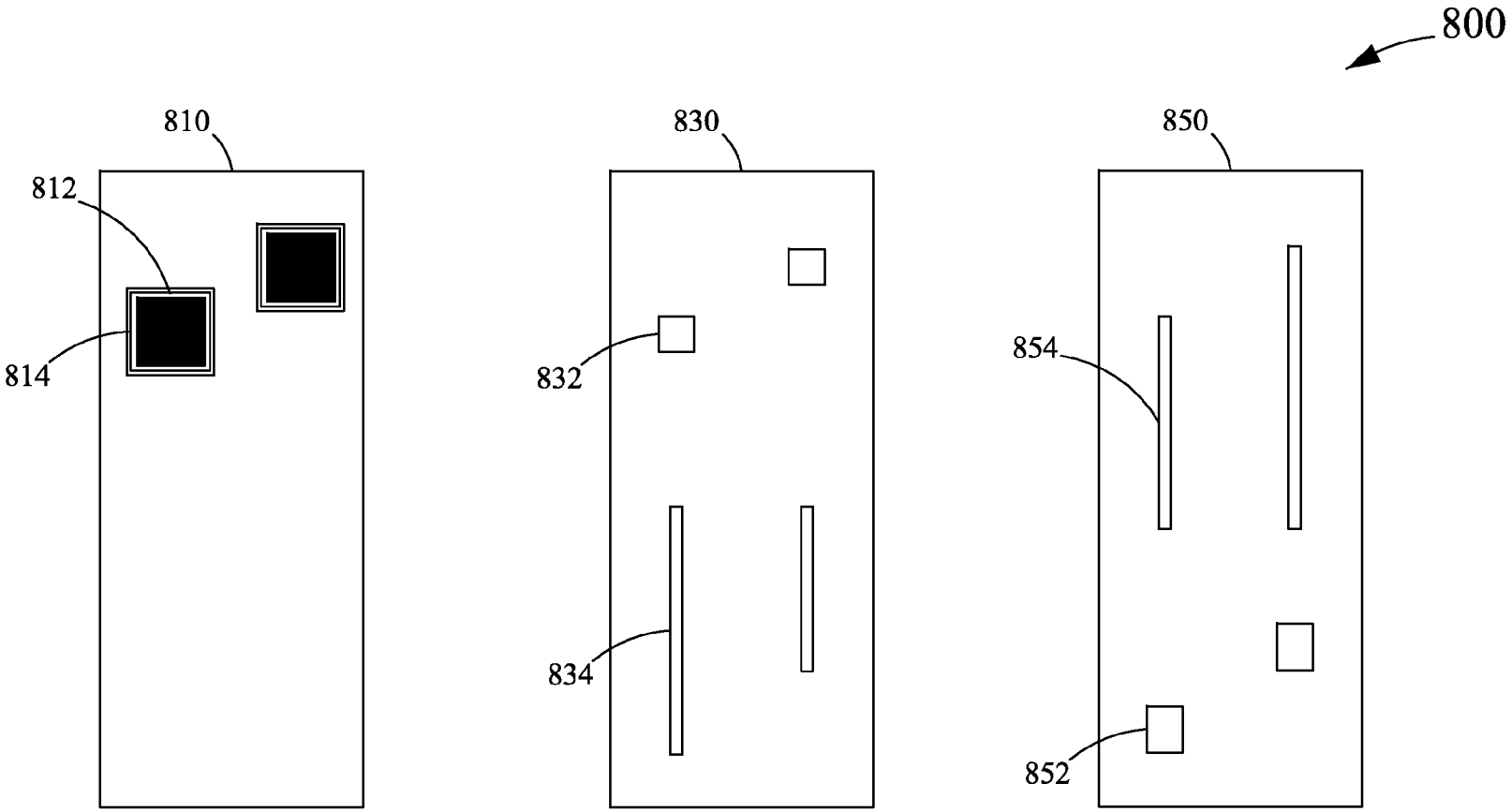
FIG. 19 illustrates a second set of masks utilized to fabricate a supporting unit of a printhead of the present disclosure.

In accordance with another embodiment, FIGS. 20-26 illustrate a second process flow, i.e., DRIE and wet anisotropic silicon etching for fabrication of a supporting unit 700 of a printhead of the present disclosure. The supporting unit 700 is similar to the supporting unit 270, and includes a first plurality of ports, such as a port 702, structurally and configurationally similar to the ports 274; a first plurality of channels, such as a channel 704, structurally and configurationally similar to the channels 278; a second plurality of ports, such as a port 706, structurally and configurationally similar to the ports 280; and a second plurality of channels, such as a channel 708, structurally and configurationally similar to the channels 284. However, the supporting unit 700 includes a plurality of trenches, such as the trenches 710, configured in the form of concentric shapes, for example two concentric squares and the like. The supporting unit 700 may also be fabricated from the silicon wafer 600 by using a second set of masks 800 depicted in FIG. 19. Specifically, FIG. 19 depicts a fourth mask 810, a fifth mask 830 and a sixth mask 850 (photo-resist mask) in the second set of masks 800.

Further, FIGS. 20-26 illustrate cross-sectional views of the silicon wafer 600 depicting the formation of the port 702, the channel 704, the port 706, the channel 708, and two trenches 710 of the supporting unit 700, only for the purposes of simplicity. Accordingly, it should be understood that other ports of the first plurality of ports, other channels of the first plurality of channels, other ports of the second plurality of ports, other channels of the second plurality of channels, and other trenches of the plurality of trenches may also be formed simultaneously using the same second process flow.

Figure 20:
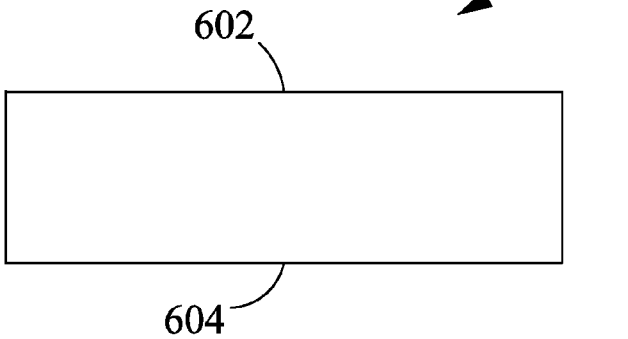
FIG. 20-26 illustrate cross-sectional views for the silicon wafer being used for fabricating the supporting unit with the help of the second set of masks of FIG. 19, in accordance with another embodiment of the present disclosure.
Figure 21:
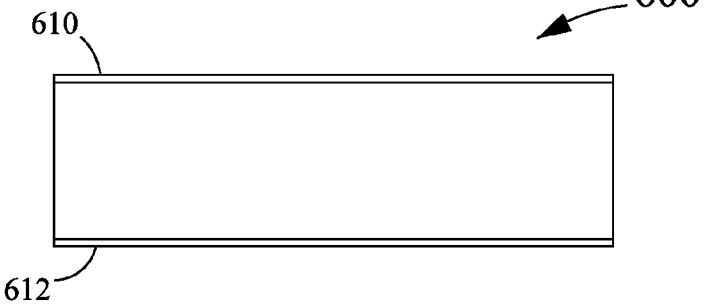

According to the second process flow, the top surface 602 and the bottom surface 604 of the silicon wafer 600 of FIG. 20 are coated with one of thermally grown and chemical vapor deposited silicon oxide, depicted as the top layer 610 and the bottom layer 612 in FIG. 21.

Figure 22:
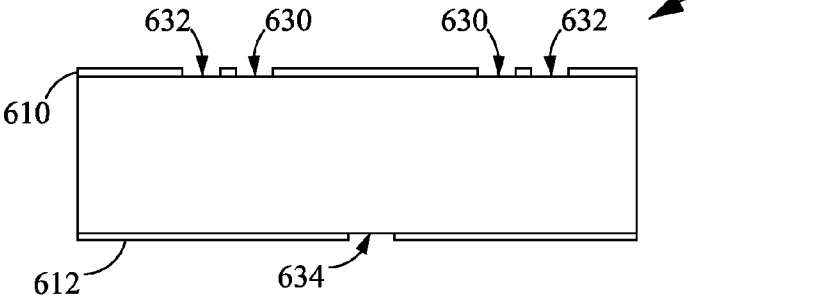

Subsequently, the top surface 602 is fabricated in a fourth predetermined pattern, as depicted in FIG. 22, using the fourth mask 810 to define the trenches 710. Specifically, the top surface 602 is etched by BOE in the fourth predetermined pattern that corresponds to the fourth mask 810. As depicted in FIG. 19, the fourth mask 810 includes a plurality of concentric openings, such as an opening 812 and an opening 814, in the form of concentric squares, corresponding to two concentric trenches 710. It should be understood that the fourth mask 810 has been shown to include only four openings for the purposes of simplicity, however, the fourth mask 810 may have any number of such openings depending on the number of the trenches 710 of the supporting unit 700. As depicted in FIG. 22, the top surface 602 is patterned to remove portions of silicon oxide to form a plurality of recesses, such as a recess 630 and a recess 632, in the top layer 610 to define the two trenches 710, when the fourth mask 810 is placed over the top layer 610 provided on the top surface 602 of the silicon wafer 600.

Thereafter, the bottom surface 604 is fabricated in a fifth predetermined pattern, as depicted in FIG. 22, using the fifth mask 830 to define the second plurality of ports and the second plurality of channels at a bottom portion of the supporting unit 700.

Specifically, the bottom surface 604 is patterned by BOE in the fifth predetermined pattern that corresponds to the fifth mask 830. As depicted in FIG. 19, the fifth mask 830 includes a plurality of openings, such as an opening 832, corresponding to the second plurality of ports, such as the port 706; and a plurality of slots, such as a slot 834, corresponding to the second plurality of channels, such as the channel 708, of the supporting unit 700. It should be understood that the fifth mask 830 has been shown to include only two openings and two slots for two types of fluids (i.e., fluids of specific types), however, the fifth mask 830 may include any number of such openings and slots depending on the number of ports of the second plurality of ports and channels of the second plurality of channels of the supporting unit 700. As depicted in FIG. 22, the bottom surface 604 is etched to remove portions of silicon oxide to form a plurality of recesses, such as a recess 634, in the bottom layer 612 to define the port 706, when the fifth mask 830 is placed over the bottom layer 612 provided on the bottom surface 604 of the silicon wafer 600.

Figure 23:
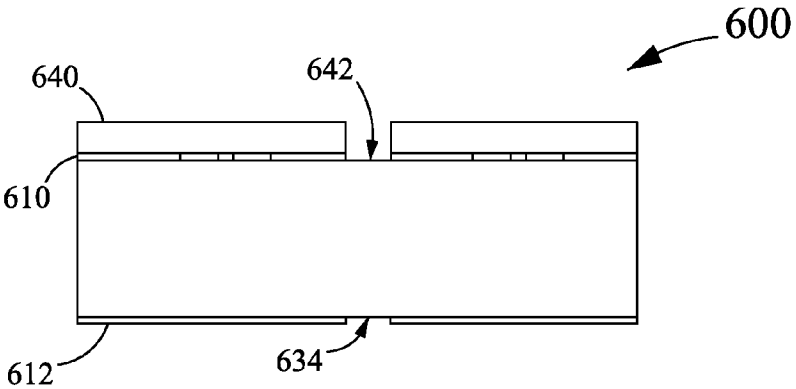
Figure 26:
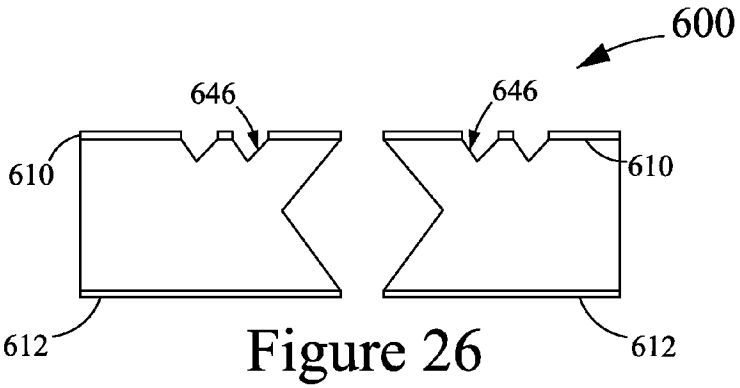

Subsequently, the top surface 602 of the silicon wafer 600 is fabricated in a sixth predetermined pattern, using the sixth mask 850 for coating the top surface 602 with a layer 640 of a photo-resist material, as depicted in FIG. 23. Specifically, the sixth mask 850 is patterned with the fourth mask 810 on the top surface 602 and the fifth mask 830 on the bottom surface 604. The layer 640 includes a plurality of recesses, such as a recess 642, corresponding to the first plurality of ports, such as the port 702 and the first plurality of channels, such as the channel 704. The sixth predetermined pattern corresponds to the sixth mask 850. As depicted in FIG. 19, the sixth mask 850 includes a plurality of openings, such as an opening 852, corresponding to the first plurality of ports, such as the port 702; and a plurality of slots, such as a slot 854, corresponding to the first plurality of channels, such as the channel 704, of the supporting unit 700. It should be understood that the sixth mask 850 has been shown to include only two openings and two slots for two types of fluids (i.e., fluids of specific types), however, the sixth mask 850 may include any number of such openings and slots depending on the number of ports of the first plurality of ports and channels of the first plurality of channels of the supporting unit 700. As depicted in FIG. 23, the top surface 602 is patterned with the layer 640, while forming the plurality of recesses in the top layer 610 to define the ports 702 and the channels 704, when the sixth mask 850 is placed over the top surface 602 of the silicon wafer 600.

Figure 24:
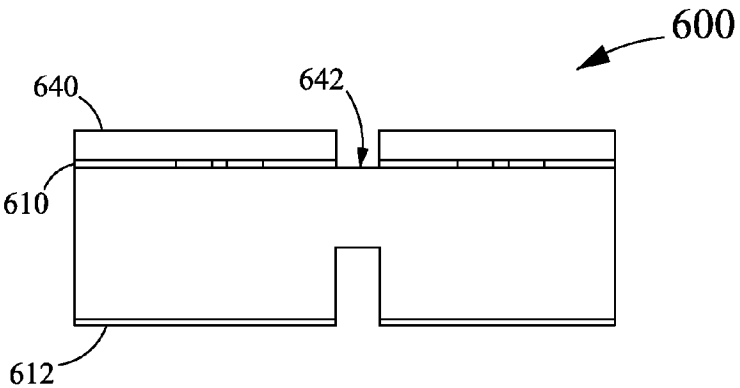

Thereafter, the bottom surface 604 is etched to form the second plurality of ports, such as the port 706, and the second plurality of channels, such as the channel 708, at the bottom portion of the supporting unit 700, as depicted in FIG. 24. Specifically, a DRIE process is used to recess the exposed silicon from the bottom surface 604 to ½ of the thickness of the silicon wafer 600.

Figure 27:
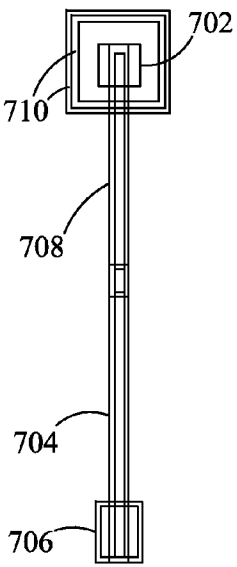
FIG. 27 illustrates an overlay for a first and a second plurality of channels, a first and a second plurality of ports, and a plurality of trenches of the supporting unit fabricated using the second set of masks of FIG. 19.
Figure 25:
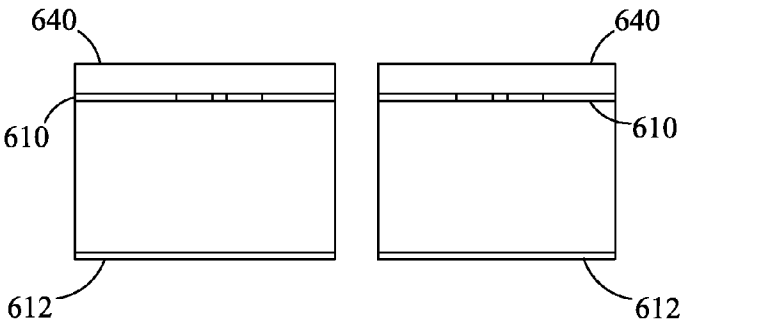

Subsequently, the top surface 602 is etched to form the first plurality of ports, such as the ports 702, and the first plurality of channels, such as the channel 704, at a top portion of the supporting unit 700, as depicted in FIG. 25. Specifically, a DRIE process is used to recess the exposed silicon from the top surface 602 to ½ of the thickness of the silicon wafer 600 for fluidly coupling each port of the first plurality of ports (such as the port 702) with a corresponding channel of the second plurality of channels (such as the channel 708), each channel of the second plurality of channels (such as the channel 708) with a corresponding channel of the first plurality of channels (such as the channel 704), and each channel of the first plurality of channels (such as the channel 704) with a corresponding port of the second plurality of ports (such as the port 706). FIG. 27 illustrates an overlay for the ports 702 and 706, the channels 704 and 708, and the trenches 710 of the supporting unit 700 fabricated using the second set of masks of FIG. 19.

The layer 640 of the photo-resist material is then removed/stripped from the top surface 602. Subsequently, the silicon wafer 600 is further etched anisotropically to obtain a seventh predetermined pattern for configuring the trenches 710. Specifically, the silicon wafer 600 is further etched anisotropically to obtain the seventh predetermined pattern to form a plurality of slots 646 that correspond to the trenches 710. Specifically, the silicon wafer 600 is submerged in hot Tetramethyl ammonium hydroxide (TMAH) solution for anisotropic etching that stops at <111> silicon crystal planes to result in the formation of V-shaped trenches. Alternatively, potassium hydroxide (KOH) may be used for the anisotropic etching of the silicon wafer 600.

Figure 28:
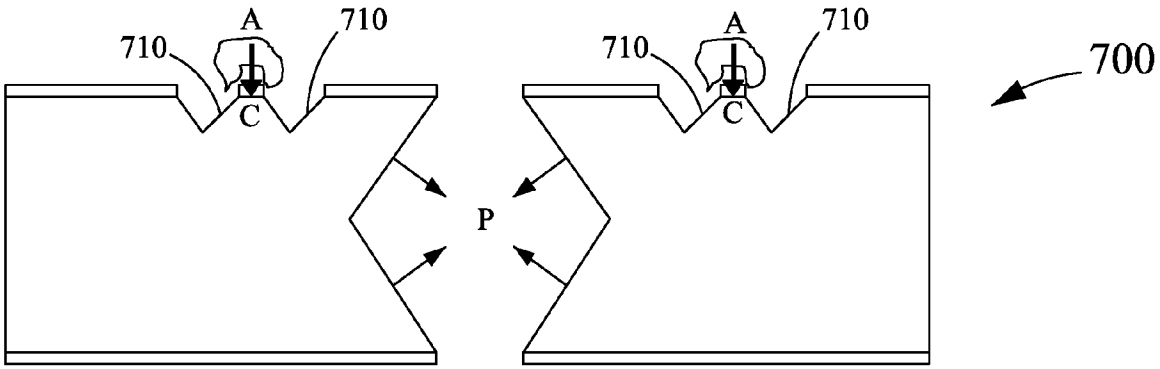
FIG. 28 illustrates a cross-section view of the supporting unit fabricated in a first configuration by using the second set of masks of FIG. 19, in accordance with an embodiment of the present disclosure.
Figure 29:
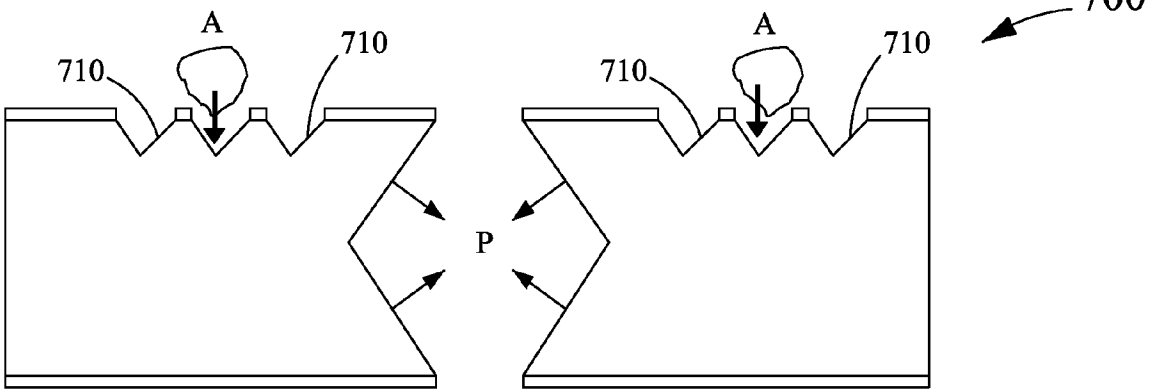
FIG. 29 illustrates a cross-section view of the supporting unit fabricated in a second configuration by using the second set of masks of FIG. 19, in accordance with another embodiment of the present disclosure.

FIGS. 28 and 29 illustrate cross-sectional views of the supporting unit 700 (final etched structure) with two and three V-shaped trenches/grooves 710, respectively, as obtained by DRIE and anisotropic etching, which stops at <111> silicon crystal plane (depicted by 'P'). FIG. 28 depicts two of the trenches 710 (concentric trenches) with 0.15 millimeter (mm) width. Further, an adhesive depicted as 'A' may be received at a center plateau 'C' (adhesive receptor). FIG. 29 depicts three of the trenches 710 (concentric trenches) with 0.1 mm width. Further, a center trench 710 may be used as an adhesive receptor. It should be understood that the dimensions of each trench 710 may be optimized according to adhesive physical properties, such as viscosity, reflowability and wettability. Further, volume and number of the trenches 710 may also be optimized according to the properties of the adhesive.

The sequence of the above-specified steps, as depicted in FIGS. 20-26, for fabricating the supporting unit 700 should not be construed as a limitation to the scope of the present disclosure. Further, FIGS. 20-26 only depict the fabrication of the supporting unit 700, accordingly, it should be understood that other supporting units, may also be fabricated in the manner similar to that for the supporting unit 700 for assembling a printhead similar to the printhead 200 of FIGS. 2 and 3.

As depicted in FIGS. 20-26, the combination of DRIE and anisotropic etching results in much narrower channel openings to contact sealing polymer with similar channel cross section, and much wider seal distance between each channels as opposed to the only DRIE method of FIGS. 10-17. Further, the anisotropic etching of the silicon wafer 600 results in the formation of V-shaped grooves for the trenches 710 and reforms the DRIE etched first plurality and second plurality of channels (such as the channels 704 and 708) by enlarging inner portions thereof, while keeping the size of respective openings of the first plurality and the second plurality of channels to be fixed. Accordingly, the openings of the first plurality and the second plurality of channels may be minimized for easy sealing and less fluid (ink) contact area on less hydrophilic sealing polymer (lowering the air trapping possibility), while the inner portions of the first plurality and the second plurality of channels have the similar volume as the first and the second plurality of channels (such as the channels 278 and 284) of the supporting unit 270 fabricated using the DRIE only process of FIGS. 10-17.

The openings of the first plurality of channels (such as the channel 704) of the supporting unit 700 and openings of the first plurality of channels (such as the channel 278) of the supporting unit 270 may be sealed by various methods. For example, the adhesive may be provided around respective openings by either dot or needle dispensing, and then PCB may be attached onto the supporting units 700 and 270 to seal the openings. The PCB may also be used for providing electrical connections to respective corresponding ejection chip units for the supporting units 700 and 270 via wire bonds. Alternatively, the respective first plurality of channels may be filled with a sacrificial polymer, such as thermally decomposable polymer (Unity® or Avatrel®), then an adhesive film may be laminated over the supporting units 700 and 270 to seal the openings of the respective first plurality of channels, and the sacrificial polymer may then be decomposed after the adhesive film is completely cured with a requirement. The adhesive film may be a hydrophobic adhesive film. Decomposing temperature of the adhesive may be greater than the decomposing temperature of the sacrificial polymer, which in turn may be greater than the curing temperature of the adhesive.

There is another advantage to seal the openings of the respective first plurality of channels with a hydrophobic adhesive film. Specifically, air bubbles trapped inside fluid (ink) channels of the corresponding ejection chip units may be vented out through the adhesive film, i.e., breathable membrane. Further, the hydrophobic adhesive film may be configured as a porous film with micro pores having a submicron diameter to evade gas bubbles from inside micro-fluidic fluid (ink) channels through the micro pores, while surface tension of a fluid (i.e., ink) may retain the fluid inside the micro-fluidic channels. The hydrophobic adhesive film does not affect fluid/ink transport especially when the combination of DRIE and anisotropic etching is used to fabricate a supporting unit with channels having narrow openings and wide inner portions.

While assembling the printhead (such as the printhead 200) of the present disclosure, a thin layer (about 20 microns) of a thermosetting adhesive may also be coated on a base unit (such as the base unit 330) before attaching a supporting unit (such as the supporting unit 270) by a means such as a roller coater, a sprayer, a stencil printing, lamination, and the like. Further, openings (long openings) of the second plurality of channels (such as the channel 284) may be sealed by the adhesive on the base unit.

Figure 30:
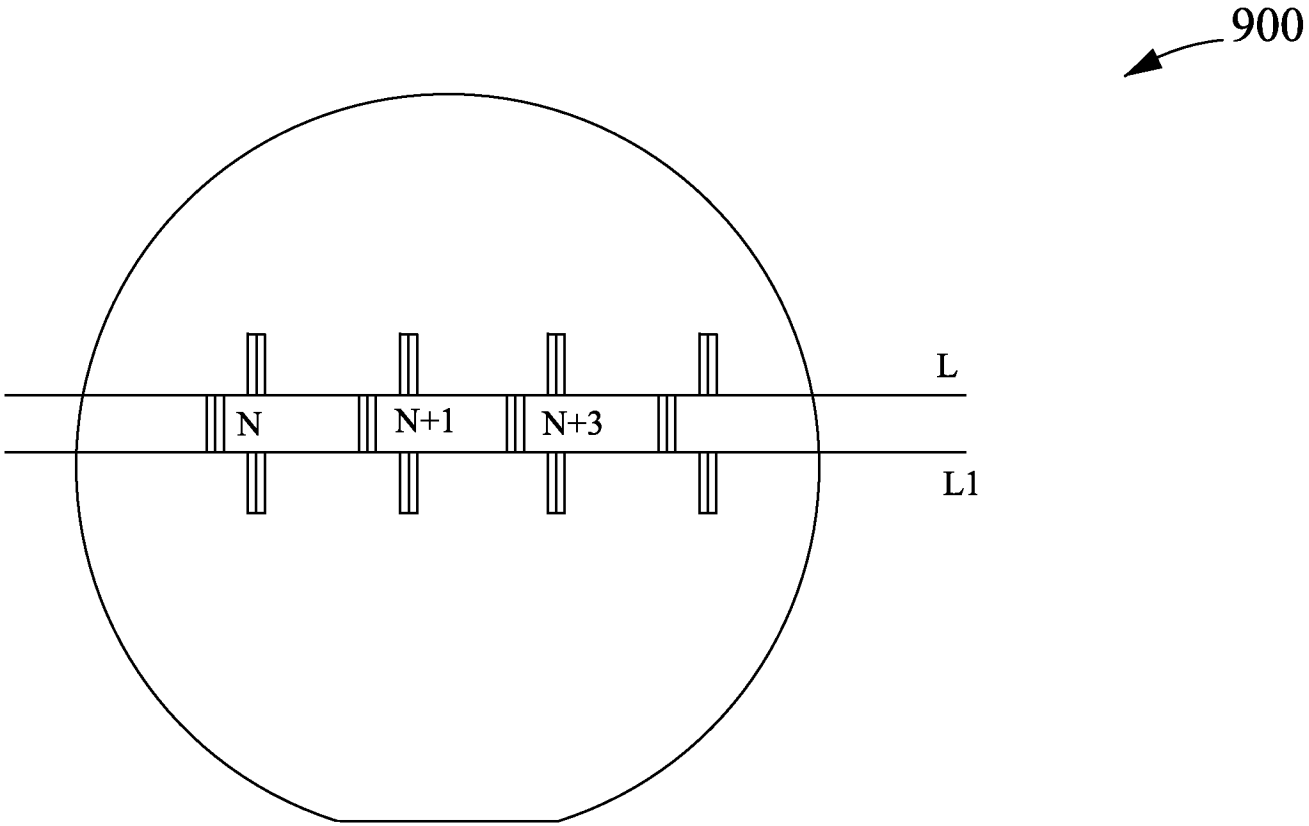
FIG. 30 illustrates a layout of a plurality of supporting units on a silicon wafer, in accordance with an embodiment of the present disclosure.

For a page wide printhead assembly, length of a supporting unit (parallel to a corresponding ejection chip unit) is a critical dimension, considering that photolithography has a submicron precision. Further, separation streets may be etched along a width of the supporting unit (as depicted in FIG. 30), i.e., between each supporting unit of the plurality of supporting units on a silicon wafer 900 (similar to the silicon wafer 600) using the anisotropic chemical etching of FIGS. 20-26. Specifically, V-groove trenches (such as the trenches 710) may be etched from both sides of the silicon wafer 900, and supporting units (such as 'N', 'N+1', 'N+3') are separated when bottom portions of the V-groove trenches meet. The separation along the length may be done by mechanical dicing, depicted along lines 'L' and 'L1'. For improved robustness of etched silicon wafer, a layout as depicted in FIG. 30 may be used, where neighboring rows of supporting units are staggered. As depicted in FIG. 30, the layout of the plurality of supporting units on the silicon wafer 900 with double side V-groove separation streets along the width thereof, and mechanic dicing along the lines 'L' and 'L1' finally separates the supporting units. Such a layout increases the mechanical strength of the silicon wafer 900 after etching.

Based on the foregoing, the present disclosure provides an efficient printhead (such as the printhead 200) and an efficient method for assembling the printhead to address the issues related with heat dissipation from ejection chip units of the printhead and deformation/bowing of the ejection chip units, while averting any air bubble entrapment/fluid (ink) clogging within the printhead. Further, the configuration of trenches within supporting units (silicon tiles) of the printhead helps in addressing the issues related with alignment tolerances within the printhead.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. A printhead for a printer, the printhead comprising:

a plurality of ejection chip units, each ejection chip unit of the plurality of ejection chip units configured to eject at least one fluid therefrom;

a plurality of supporting units, each supporting unit of the plurality of supporting units fluidly coupled with a corresponding ejection chip unit of the plurality of ejection chip units, the each supporting unit comprising:

a plurality of trenches adapted to receive an adhesive to facilitate attachment of the each supporting unit with the corresponding ejection chip unit of the plurality of ejection chip units;

a first plurality of channels fluidly coupled with a respective ejection chip unit; and a second plurality of channels laterally offset from and fluidly coupled with respective channels of the first plurality of channels; and a base unit fluidly coupled with the each supporting unit of the plurality of supporting units and configured to carry the plurality of supporting units thereupon, the base unit adapted to provide the at least one fluid to the each ejection chip unit of the plurality of ejection chip units through a corresponding supporting unit fluidly coupled to the each ejection chip unit.

2. The printhead of claim 1, wherein the each ejection chip unit comprises, a first plurality of ports for fluid ejection, a plurality of fluid channels configured beneath the first plurality of ports, each fluid channel of the plurality of fluid channels fluidly coupled with at least one corresponding port of the first plurality of ports, and a second plurality of ports configured beneath the plurality of fluid channels, at least one port of the second plurality of ports fluidly coupled with a corresponding fluid channel of the plurality of fluid channels.

3. The printhead of claim 2, wherein the each supporting unit comprises, a first plurality of ports configured at a top portion of the each supporting unit, each port of the first plurality of ports fluidly coupled with a corresponding port of the second plurality of ports of the each ejection chip unit, the first plurality of channels configured at the top portion of the each supporting unit, a second plurality of ports configured at a bottom portion of the each supporting unit, each port of the second plurality of ports fluidly coupled with a corresponding channel of the first plurality of channels, and the second plurality of channels configured at the bottom portion of the each supporting unit, each channel of the second plurality of channels fluidly coupled with a corresponding port of the first plurality of ports.

4. The printhead of claim 3, wherein the base unit comprises a plurality of channels, each channel of the plurality of channels fluidly coupled with at least one corresponding port of the second plurality of ports of the each supporting unit.

5. The printhead of claim 4, wherein the base unit further comprises a plurality of ports beneath the plurality of channels, at least one port of the plurality of ports fluidly coupled to a corresponding channel of the plurality of channels, further the at least one port being fluidly coupled with a corresponding fluid reservoir for receiving a fluid therefrom.

6. The printhead of claim 1, further comprising an electrically functional unit coupled with the each ejection chip unit and mounted on the corresponding supporting unit of the plurality of printhead modules.

* * * * *